US007694970B2

(12) United States Patent
Petty

(10) Patent No.: US 7,694,970 B2
(45) Date of Patent: Apr. 13, 2010

(54) GAME AND GAME APPARATUS

(76) Inventor: Gregory A. Petty, 28 Charles Stl., Bentley, W.A. (AU) 6102

( * ) Notice: Subject to any disclaimer, the term of this patent is extended or adjusted under 35 U.S.C. 154(b) by 179 days.

(21) Appl. No.: 10/571,237

(22) PCT Filed: Sep. 9, 2004

(86) PCT No.: PCT/AU2004/001219

§ 371 (c)(1),
(2), (4) Date: Mar. 8, 2006

(87) PCT Pub. No.: WO2005/023386

PCT Pub. Date: Mar. 17, 2005

(65) Prior Publication Data

US 2007/0063438 A1 Mar. 22, 2007

(30) Foreign Application Priority Data

Sep. 9, 2003 (AU) ..... 2003904910
Mar. 2, 2004 (AU) ..... 2004901035

(51) Int. Cl.
*A63F 1/00* (2006.01)

(52) U.S. Cl. ..... 273/274

(58) Field of Classification Search ..... 273/274, 273/292; 463/12, 13
See application file for complete search history.

(56) References Cited

U.S. PATENT DOCUMENTS 5,795,225 A 8/1998 Jones et al.
5,879,233 A 3/1999 Stupero
6,270,405 B1 8/2001 Ferguson
6,402,150 B1 * 6/2002 Jones ..... 273/292
6,637,748 B1 * 10/2003 Yuan ..... 273/292
6,698,759 B2 * 3/2004 Webb et al. ..... 273/292
6,837,494 B2 * 1/2005 Lee ..... 273/292
6,877,748 B1 * 4/2005 Patroni et al. ..... 273/292
6,938,900 B2 * 9/2005 Snow ..... 273/292
7,055,822 B2 * 6/2006 Lo ..... 273/292
7,066,466 B1 * 6/2006 Stavinsky et al. ..... 273/292
2002/0195776 A1 * 12/2002 Jones ..... 273/292

FOREIGN PATENT DOCUMENTS

WO WO 99/46019 9/1999

* cited by examiner

*Primary Examiner*—William M Pierce
(74) *Attorney, Agent, or Firm*—Greenberg Traurig

(57) ABSTRACT

A game apparatus comprising a player display (105) adapted to provide a display representative of a collection of tokens (106,107,108,109,110) delivered to a player by a dealer and a dealer token (111), the apparatus further comprising a player control means adapted to be operated by the player and a dealer control means adapted to be controlled by the dealer and which provides the display at the player display (105) representatives of the players collection of tokens (106,107, 108,109,110) and of the dealers token (111), and the player control adapted to enable the player to discard the representation of some of the players tokens displayed to retain a lesser number of tokens and the dealer control adapted so the dealer can compare the representation of the dealers token (111) to the players retained tokens, the comparison determining the player as having won or lost.

58 Claims, 5 Drawing Sheets

GAME AND GAME APPARATUS

This application is a national stage filing under 35 U.S.C. 371 of International Application PCT/AU2004/001 219 filed on Sep. 9, 2004 which claims priority from AU Provisional Application No. 2003 904910 filed Sep. 9, 2003 and AU Application No. 2004 901035 filed Mar. 2, 2004. The entire teachings of the referenced application is incorporated herein by reference. International Application PCT/AU2004/001219 was published under POT Article 21(2) in English.

FIELD OF THE INVENTION

The present invention relates to the field of games, card games, wagering card games and electronic games, especially casino wagering games.

Throughout the specification, unless the context requires otherwise, the word "comprise" or variations such as "comprises" or "comprising", will be understood to imply the inclusion of a stated integer or group of integers but not the exclusion of any other integer or group of integers.

BACKGROUND

As a leisure time activity poker and other card games have been popular for many years. The capital requirements for playing poker and other table card games are very low. All that are needed are one or more decks of cards, a playing surface and a few participants. Five card poker is a game that most people know how to play and many games have been developed using the same basic priority or rank order of winning poker hands: Royal Flush, Straight Flush, Four of a kind, Full House, Straight, Three of a kind, Two Pair, One Pair, and High Card(s) in hand.

For some time, it had been difficult to adapt the rules of poker into a casino table game in which each player plays against the house, rather than against other players. Although club-type games with players wagering against each other have been popular, it was desirable for a game to be played where the house received a more direct payback from the game. In a conventional poker game, a number of players (greater than one) are each dealt a poker hand by one player (or the house dealer who does not play in the game) who acts as the dealer. The player with the highest ranking hand based on the established priority ranking of poker hands wins. Each player in turn deals a hand as the game continues. It is usually essential to have wagering steps in the game to maintain the interest and excitement of the game. In the absence of wagering, there is little to commend the play of poker.

Many places, both within and without Australia, have legalized gaming. Poker is one of the games of chance offered in both casinos and gaming venues. In a conventional house poker game, the house provides a dealer, the playing cards, the table and chairs, but the house does not play a hand. The house collects a nominal percentage of each players bet (house percentage) that compensates the house for providing the facilities to the players. Alternatively, the house may charge each player a set amount per hand or for a specified length of time of play. Each player is competing not against the house, but against all the other players with the highest hand winning the total of all the wagers made on that hand.

Many people do not like to play house poker because each player is competing against his fellow players, not against the house. Many people would rather attempt to win money from an impersonal source, the house or the casino, rather than from their fellow players with whom they may be acquainted. House poker also tends to not offer any bonus payments for particularly good hands, although bonuses are sometimes paid for highest hands in tournaments or for specific combinations of hands at poker tables (eg, a losing hand of at least a full house). While a Royal Flush is a rare occurrence and generates a thrill for any poker player, the player collects the same total wager that he would have collected if the hand was won with a Three of a Kind.

In the past fifteen years, a number of card games have been introduced to provide poker type card games as house-banked casino table games. These games have focused on a number of elements in providing excitement and staying power for the games. The games must be quickly understood by players.

The rules must be simple and clear. The resolution of wagers by the dealer must be easily accomplished. The reading of hands by a dealer must not be complex. In addition, the games must provide a high enough win frequency to appeal to players, yet allow the house to retain a profitable portion of the wagers. These needs have limited the number of successful games that have been designed and successfully introduced into the casino gaming market.

Among the successful games are Let It Ride Bonus. RTM. Poker, Three Card Poker. RTM. Game and Caribbean Stud. RTM. Poker. These games have each achieved a level of commercial success with different formats and attributes.

In Caribbean Stud. RTM. Poker, a player makes an initial ante wager, and five cards are dealt to each player and to a dealer. The dealer exposes one of the five cards to influence the player. The player decides if the dealt player hand is of sufficient rank to compete against the dealer's hand. The player may fold the player's hand at that time, or continue the game by placing an additional wager (referred to as the "Bet") that is usually required to be twice the value of the ante. The dealer's hand qualifies for active play against the bet with a rank of at least Ace-King. If the dealer qualifies, the rank of the player's hands are compared with the rank of the dealer's hand. Players with hands of higher rank than the dealer's hand win both the ante and the bet. Players with hands of lower rank than the dealers hand lose both the ante and the bet. If an initial side bet (often referred to as the jackpot side bet) has been made by the player, ranked hands of particularly high values (eg, at least a flush) are paid absolute bonus amounts or may be paid out of a progressive jackpot. This bonus side bet is paid whether or not the player's hand rank exceeds the rank of the dealer's hand.

Problems with most poker games and especially the above mentioned, occur for the player in the wagering structure whereby players have to place an ante wager and then must place additional wagers at multiple odds to continue to participate in the game.

With the above games, players do have the option to fold their hand and forfeit their ante wager. These games have a fold rate of in excess of 21%. This can make games unattractive to the recreational player as the player will become bored. The player normally folds early in the game, leaving the player lengthy periods of downtime before the commencement of the next game.

It is always desirable to explore alternative games for play in the field of gaming tables to provide players with varied experiences and alternatives to known games.

DISCLOSURE OF THE INVENTION

One variation of the present invention relates to a card game that can be played in a casino or in a gaming venue. More particularly, it relates to a hybrid version of a poker game.

According to one aspect the invention resides in a game comprising a set of tokens, said set comprising a first number of sub-sets, each sub-set having an equal second number of tokens, each sub-set of tokens having a hierarchical ranking from a lowest value to an upper most value, said game comprising a dealer and at least one player, the game comprising the dealer delivering to each player a collection of tokens comprising a third number of tokens, each player assessing the collection of tokens and declaring the status of the collection as a winning group, where a winning group comprises a selection of tokens which conform to a pre-determined set of tokens, each player discarding some of the tokens to hold a fourth number of tokens, said fourth number being less than the first number, the dealer delivering a final token from the remainder of the set of tokens, the final token being compared with the fourth number of tokens held by each player wherein the player is determined as having won or lost as a result of said comparison.

According to a further aspect the invention resides in a game apparatus for playing a game which uses a set of tokens, said set comprising a first number of sub-sets, each sub-set having an equal second number of tokens, each sub-set of tokens having a hierarchical ranking from a lowest value to an upper most value, said game comprising a dealer and at least one player, the game comprising the dealer delivering to each player a collection of tokens comprising a third number of tokens, each player assessing the collection of tokens and declaring the status of the collection as a winning group, where a winning group comprises a selection of tokens which conform to a pre-determined set of tokens, each player discarding some of the tokens to hold a fourth number of tokens, said fourth number being less than the first number, the dealer delivering a final token from the remainder of the set of tokens, the final token being compared with the fourth number of tokens held by each player wherein the player is determined as having won or lost as a result of said comparison, wherein the game apparatus comprises a player display adapted to provide a display representative of the collection of tokens delivered to the player by the dealer and the final token, the apparatus further comprising a player control means which is adapted to be operated by a player and a dealer control means adapted to be controlled by a dealer and which provides the display at the player display representative of the collection of tokens and of the final token and the player control adapted to enable the player to discard the representation of some of the tokens displayed to retain the fourth number of tokens.

According to preferred feature of the invention the player makes a wager prior to the delivery of the collection of tokens and the player is paid out on winning the game. According to preferred feature of the invention additional wagers can be placed by a player at differing stages of the game. According to preferred feature of the invention an additional wager can be placed by a player after discarding tokens to establish the fourth number of tokens.

According to preferred feature of the invention the selection of tokens which conform to a pre-determined set of tokens comprise a number of selections of tokens and the selections are given a ranking according to the nature of the subsets to which each token belongs and the hierarchy of the tokens contained in the sub-set. According to preferred feature of the invention on a player having a winning hand on delivery of the collection of tokens, the player is paid out by the dealer in accordance with the ranking of the winning hand. According to preferred feature of the invention on a player having a winning hand on receipt of the collection of tokens, the player is able to continue with the game. According to preferred feature of the invention on continuing with the game the player is able to submit an additional wager. According to an alternative preferred feature of the invention on a player having a winning hand on receipt of the collection of tokens, the player is withdrawn from the game.

According to preferred feature of the invention the comparison with the final token is conducted in relation to conformity with the subset of tokens to which the final token belongs with the subset or subsets of the tokens held by each player. According to preferred feature of the invention on the final token being from a different subset to the subset or subsets of the tokens held by the player the dealer is determined as the winner and otherwise the player being determined as the winner. According to preferred feature of the invention the comparison with the final token is also conducted in relation to the subset and hierarchy of the final token having a ranking lower than the token held by the player of the same subset as of the final token the player is determined as the winner and otherwise the dealer being determined as the winner.

According to preferred feature of the invention the game requires a minimum of one player.

According to preferred feature of the invention the first number is the number 4. According to preferred feature of the invention the second number comprises the number 13. According to preferred feature of the invention the third number comprises the number 5. According to preferred feature of the invention the fourth number comprises the number 3 or less.

According to preferred feature of the invention the tokens comprise a set of conventional playing cards and the sub-sets comprising the suits of a conventional set of playing cards. According to preferred feature of the invention the winning hands are those defined as winning hands according to the rules of the card game Poker or derivatives of the card game Poker.

According to a further aspect the invention resides in a game apparatus for playing a game of the form as described above wherein the game apparatus comprises a player display adapted to provide a display representative of the tokens delivered to the player by the dealer and the final token, the apparatus further comprising a player control means which is adapted to be operated by a player and a dealer control means adapted to be controlled by a dealer to provide the display at the player display representative of the collection of tokens and of the final token and the player control adapted to enable the player to discard the representation of some of the tokens displayed.

According to preferred feature of the invention the game the control means includes an insertion means capable of accepting a value token wherein the game is activated by a player inserting a value token into the insertion means which shall be taken as the wager. According to preferred feature of the invention the value token comprises an element of representative of monetary currency. According to preferred feature of the invention the game apparatus comprises a plurality of player stations each having a player display. According to preferred feature of the invention a second display is provided at each player station at which the player can display the magnitude of the wager. According to preferred feature of the invention the dealer station is controlled by a dealer. According to preferred feature of the invention the assessment of the success of the player on receiving the collection of tokens and/or on the final token being displayed is assessed by the dealer. According to preferred feature of the invention the assessment of the success of the player on receiving the collection of tokens and/or on the final token being displayed is assessed by the dealer control means.

According to preferred feature of the invention the game apparatus is operated electronically and incorporates a processing means. According to preferred feature of the invention the dealer station is controlled by a computer programme.

The invention will be more fully understood in the light of the following description of several specific embodiments.

DETAILED DESCRIPTION OF SPECIFIC EMBODIMENTS

Figure 2:
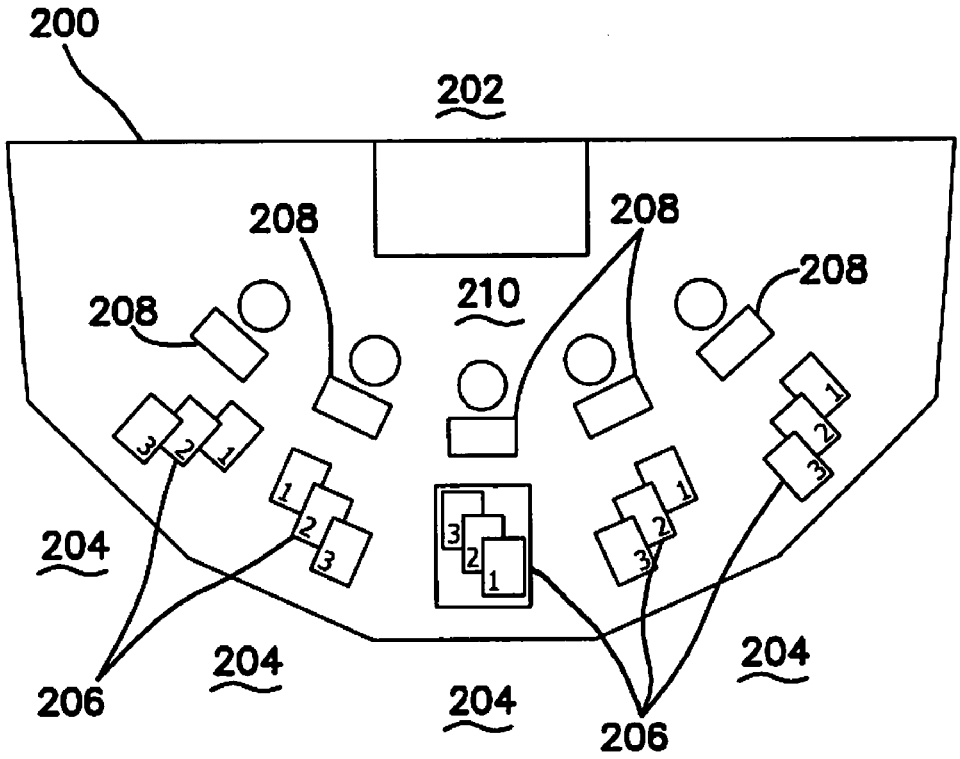
FIG. 2 shows a gaming table of the type that may be used to facilitate a live embodiment of the present invention.
Figure 3:
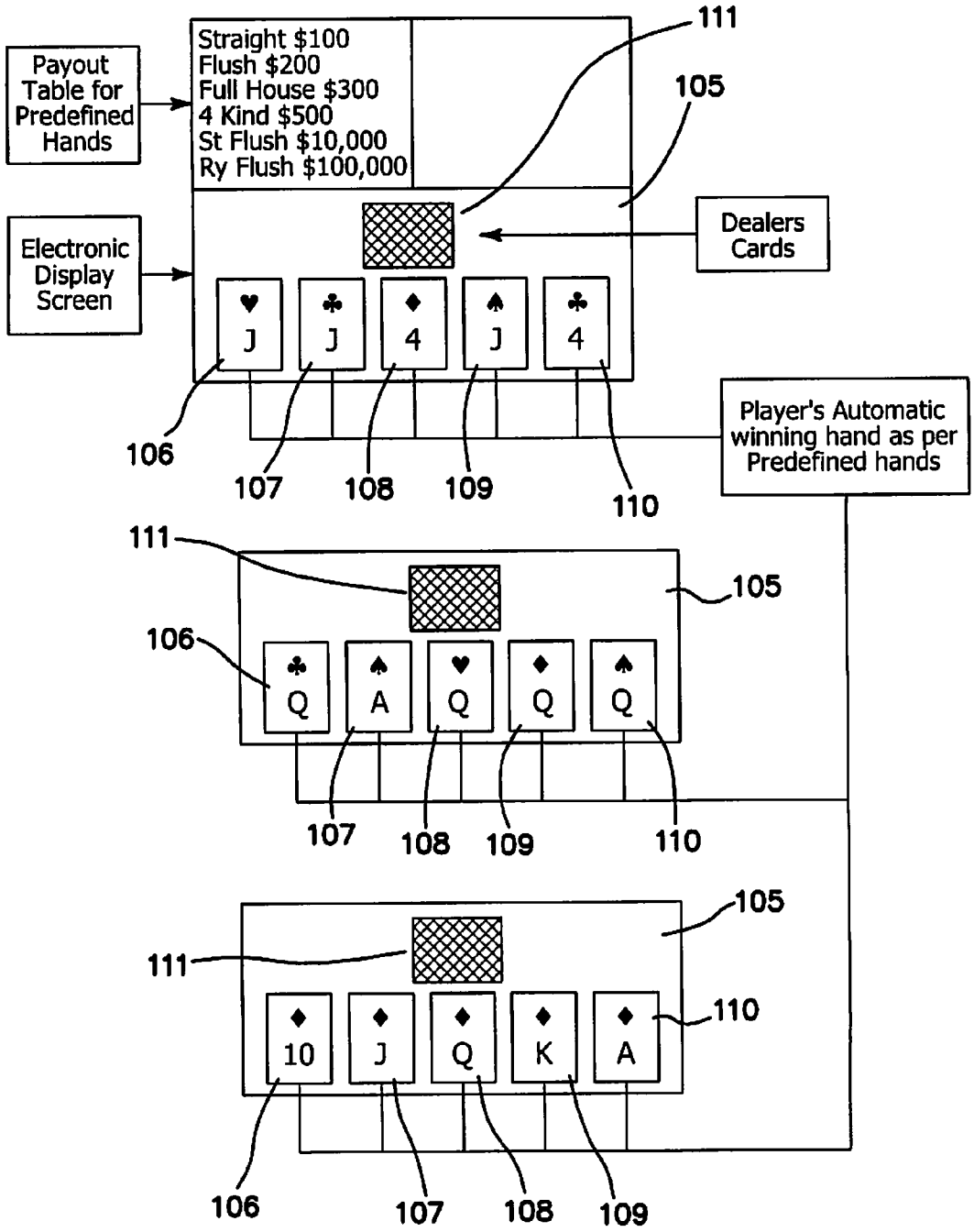
FIG. 3 shows multiple display screens depicting various winning hands.
Figure 4:
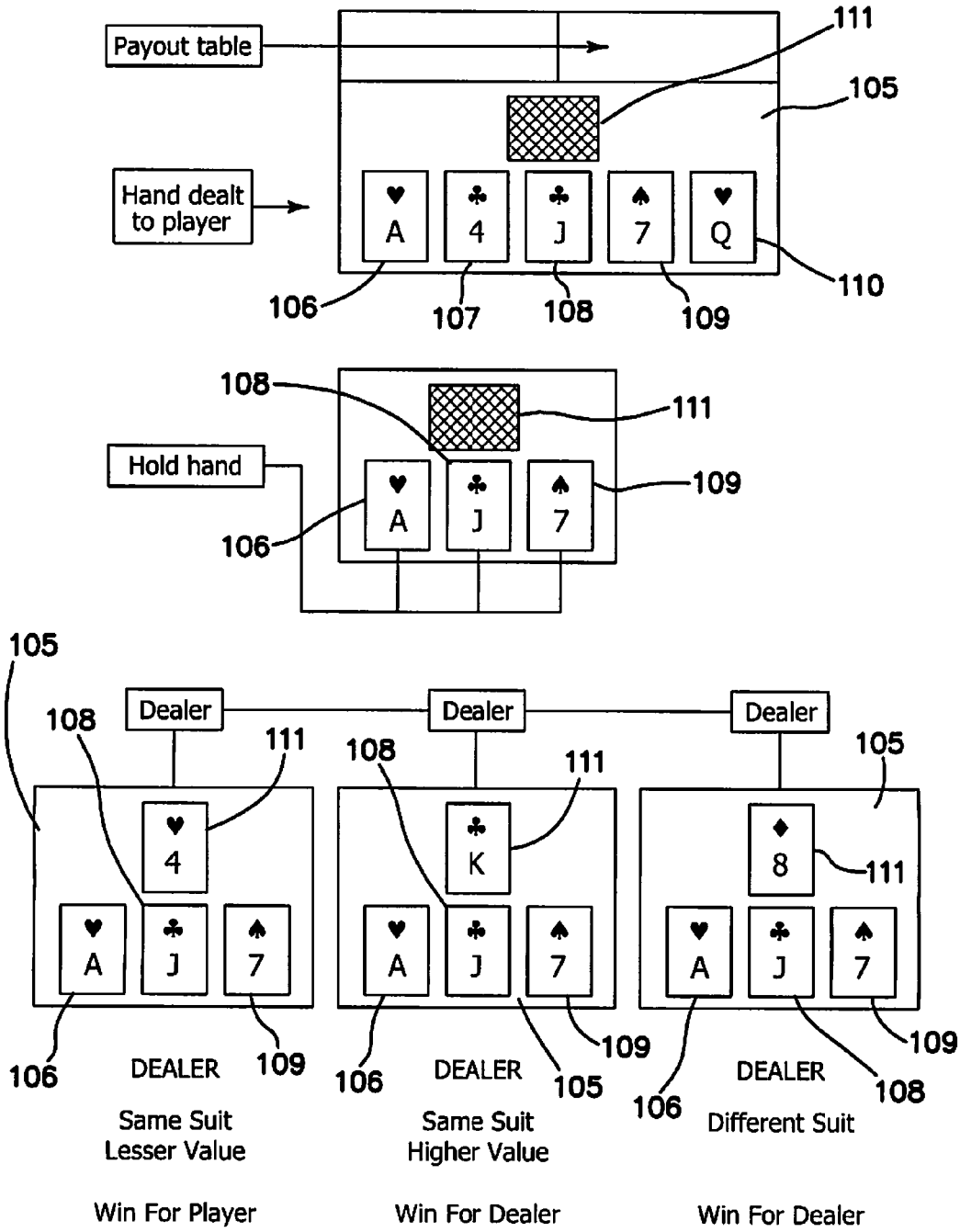
FIG. 4 shows a display screen depicting an initial player hand, hold hand and various outcomes based on different exposed independent cards (i.e., dealer cards).

FIG. 2 illustrates the layout of a gaming table for use in playing the card game in accordance with the first embodiment.

The first embodiment of the card game described is played with a standard deck of 52 cards. A table (200) is provided which includes a dealer location (202) and a plurality of player locations (204). In front of each of the player locations (204) is provided a card placement area (206) and a wager area (208). Each hand of the card game is initiated by each player placing an initial wager into the wager area (208). The amount of the initial wager will be set between a predefined minimum and maximum for the table. The embodiment of the game described is based on poker and therefore following placement of the initial wager, the dealer deals each of the players 5 cards, which are placed face down in the card placement areas (206). Each player examines their hand and determines if the hand is either a winning hand, a non-winning hand or an unplayable hand.

A winning hand is defined to be one of a plurality of predefined hands. As the embodiment described is based on poker, the predefined hands are known poker hands.

In this case a winning hand is a poker hand of Two Pair or higher. If the player determines that their hand is a winning hand, that player declares their hand a winning hand and places the hand face down in the card placement area (206).

An unplayable hand is defined to be a hand which comprises a Two, a Three, a Four, a Five (all of the same suit) and another Two. This hand is defined as unplayable as there is no possibility of winning with these cards, as will become evident. The player declares their hand an unplayable hand and places the hand face down in the card placement area (206).

A non-winning hand is defined to be any hand which is not a winning or unplayable hand.

Any player that declares their hand to be a non-winning hand now discards 2, 3 or 4 cards from their hand so that they retain no more than one card from any one suit. That is, no more than 3 cards can be held. The discarded cards are placed faced down on the table (210). The cards that have been held will be referred to as the hold hand. The hold hand is placed in the card placement area (206).

The dealer then exposes any declared winning hand and pays the player, based on their initial wager, according to predefined odds for each winning hand. The following table sets out predefined odds for winning hands which would be suitable for playing the game.

| Type of Hand | Odds for Payout |
|---|---|
| Two Pair | 1 to 1 |
| Three of a Kind | 1 to 1 |
| Straight | 2 to 1 |
| Flush | 4 to 1 |
| Full House | 5 to 1 |
| Four of a Kind | 20 to 1 |
| Straight Flush | 50 to 1 |
| Royal Flush | 200 to 1 |

Variations to the above odds or predefined payout amounts are deemed appropriate.

The dealer then exposes any declared unplayable hand and returns the player's initial wager.

If any player declares a winning hand that is not a winning hand or an unplayable hand that is not an unplayable hand, that player forfeits their initial wager.

The dealer then exposes the hand of any player who has a hold hand and deals a sixth card to each of those players. If the sixth card is the same suit as one of the cards of the player's hold hand and less in value than that card, then the dealer pays that player an amount based on their initial wager and predefined odds for the held hand. In one embodiment, the player is simply paid an amount equal to the initial wager. In a further embodiment, the player is paid at odds based on the number of cards in the hold hand.

The player loses their initial wager if the sixth card is either of a different suit to the cards of the hold hand, or of the same suit as one of the cards of the hold hand but higher in value than said card.

It will be appreciated that while the dealer may deal a separate card to each player which acts as the sixth card for that player, the dealer may also deal a single card which is to act as the sixth card for every player.

If at any point, the dealer deals cards incorrectly or exposes dealt cards, the dealer will declare the hands void and the round will be cancelled.

Figure 5:
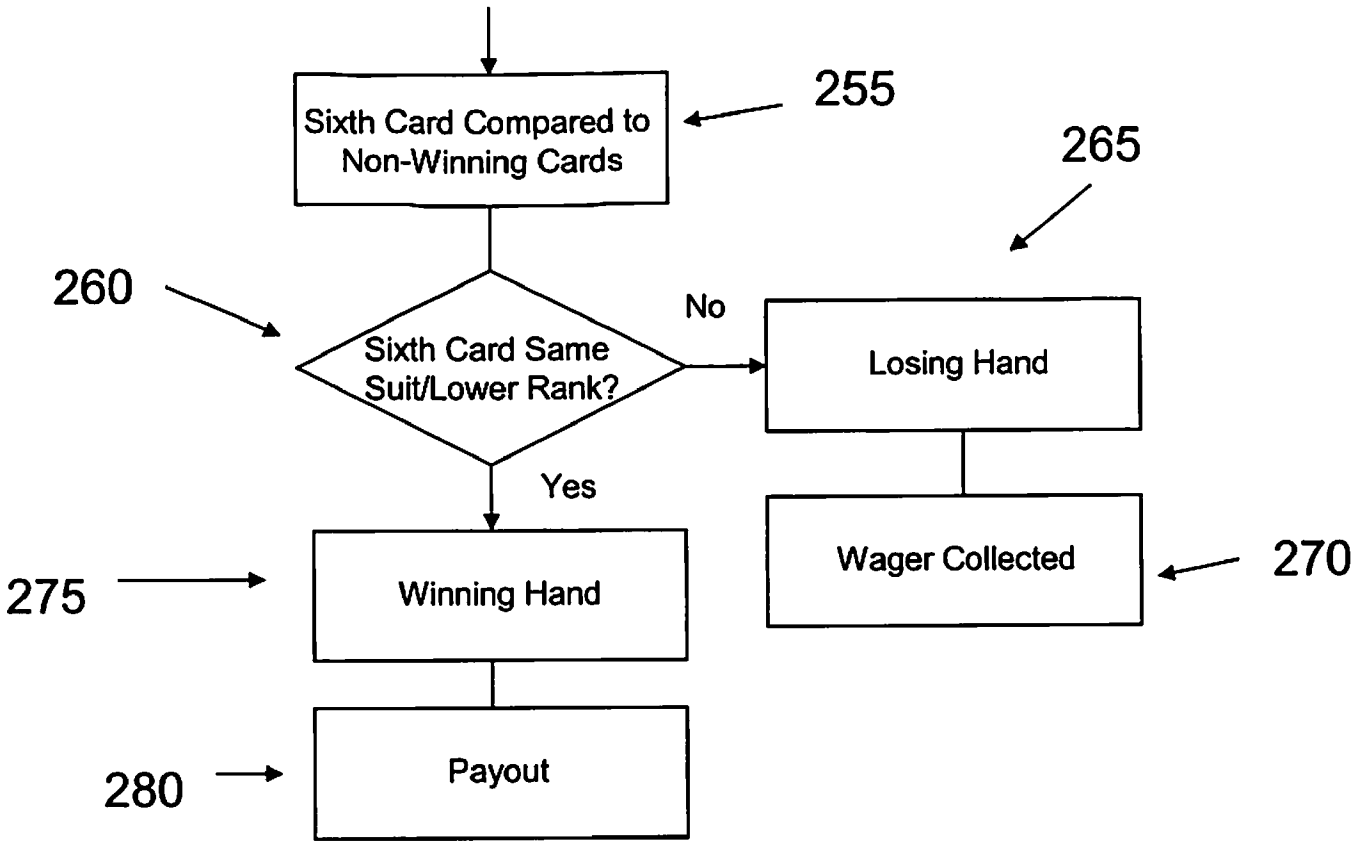
FIG. 5 illustrates a flow chart detailing one playing card embodiment of the present invention.

FIG. 5 shows a flow chart 200 detailing one playing card embodiment of the present invention. At 205, players place wagers. At 210, each player is dealt five cards. At 215, players declare their hand a winning hand, non-winning hand or unplayable hand. At 220, a hand is declared a winning hand and, at 225, players holding a declared winning hand receive a payout based on the poker rank of the winning hand. At 230, a hand is declared an unplayable hand and, at 235, players holding a declared unplayable hand receive their wager back. At 240, a hand is declared non-winning and, at 245, players holding a declared non-winning hand discard 2, 3 or 4 cards such that the player holds no more than three cards and no more than one card of any suit. At 250, a sixth card is dealt. The sixth card may be dealt to each player holding a non-winning hand or a single sixth card may be used for all players holding a non-winning hand. At 255, the sixth card is compared to the cards held from each non-winning hand. At 260, if the sixth card is of the same suit as one of the cards held from a non-winning hand and ranks lower than the card of the same suit in the players hand, at 265, the hand is deemed a winning hand and, at 270, a payout is made to the player. If not, at 275, the hand is deemed a losing hand and, at 280, the players wager is collected.

There are many variation of games that may be played within the scope of the present invention. The following variations shall be described in a manner that should enable those skilled in the art to appreciate the expanded scope of play available, rather than considering any single described method as limiting the intended scope of the game.

A second embodiment of the card game according to the invention is played with a standard deck of 52 cards. Each hand of the card game is initiated by each player placing an initial wager. The dealer deals each of the players 5 cards, which the player examines to determine if that hand is a winning hand.

A winning hand is defined to be one of a plurality of predefined hands, the following hands would be deemed appropriate.

5 cards same suit.

5 cards same suit in numerical order.

5 cards same suit Ten, Jack, Queen, King, Ace.

5 cards—Unplayable (that is 5 cards that have no chance of winning within this embodiment of the present invention).

If the player determines that their hand is a winning hand, that player declares their hand a winning hand and places the hand face down in the card placement area.

A non-winning hand is defined to be any hand which is not a winning hand.

Any player that determines their hand to be a non-winning hand, now discards 2, 3, or 4 cards from their hand so they retain no more than one card from any one suit. That is no more than 3 cards can be held. The discarded cards would be removed from the table by the dealer.

The dealer then exposes any declared winning hands and pays the player based on the following chart.

| | |
|---|---|
| Same Suit | $100.00 |
| Unplayable | $1000.00 |
| Same Suit/Numerical Order | $10,000.00 |
| Same Suit/Ten, Jack, Queen, King, Ace | $100,000.00 |

Variations to the above set amounts or predefined payouts at odds are deemed appropriate.

After payment, players with winning hands will be given the option to continue or stand off their initial wager. Any winning hand would become a special 5 card hold hand.

In the embodiment, players with non-winning hands will have the option of placing an additional wager equal to the amount of their initial wager before their hold hand is exposed.

The dealer then exposes the hand of any player who has a hold hand and deals a sixth card to each of those players. If the sixth card is the same suit as one of the cards of the players hold hand and less in value than that card, then the dealer pays that player an amount based on their initial wager and predefined odds for the held hand.

One Suitable set of payout odds is as follows,

Hold hand of 5 cards—5 to 1.

Hold hand of 3 cards—1 to 1.

Hold hand of 2 cards—3 to 2.

Hold hand of 1 card—2 to 1.

Any additional wagers would be payed at the same odds as the initial wagers.

The player loses their initial wager and any additional wager if the sixth card is either of a different suit to the cards of the hold hand, or of the same suit as one of the cards of the hold hand but higher in value than said card.

A third embodiment of the invention comprises a card game played with 2 or more mixed standard decks of cards preferably 4 decks of standard 52 cards.

Each hand of the card game is initiated by each player placing an initial wager. The dealer deals each of the players 3 cards face up with the player being able to declare their 3 card hand a winning hand.

A winning hand is defined to be one of a plurality of predefined hands. As the embodiment described is based on poker, the predefined hands are known poker hands.

In this case a winning hand is a poker hand of one pair or higher. According to the hierarchy of 3 card poker hand rankings, payout at odds would be payed for the different standing of the ranked hands.

After payment of winning hands, all players would still be participating in the game. Players would now have the option of placing an additional wager equal to the initial wager.

The dealer deals a fourth card face up to each player. If the fourth card is the same suit as one of the cards of the players hand and less in value than that card, then the dealer pays that player an amount equal to the initial wager and any additional wager.

The player loses their initial wager and any additional wager if the fourth card is either of a different suit to the cards of the player's hand, or of the same suit as one of the cards of the player's hand but higher in value than said card.

With 4 decks of cards the fourth card dealt by the dealer to the player's hand, may be of the same suit and value as one of the cards of the players' hand. In this event the dealer would pay the player an amount according to predefined odds and based on the player's initial wager and any additional wager.

Figure 1:
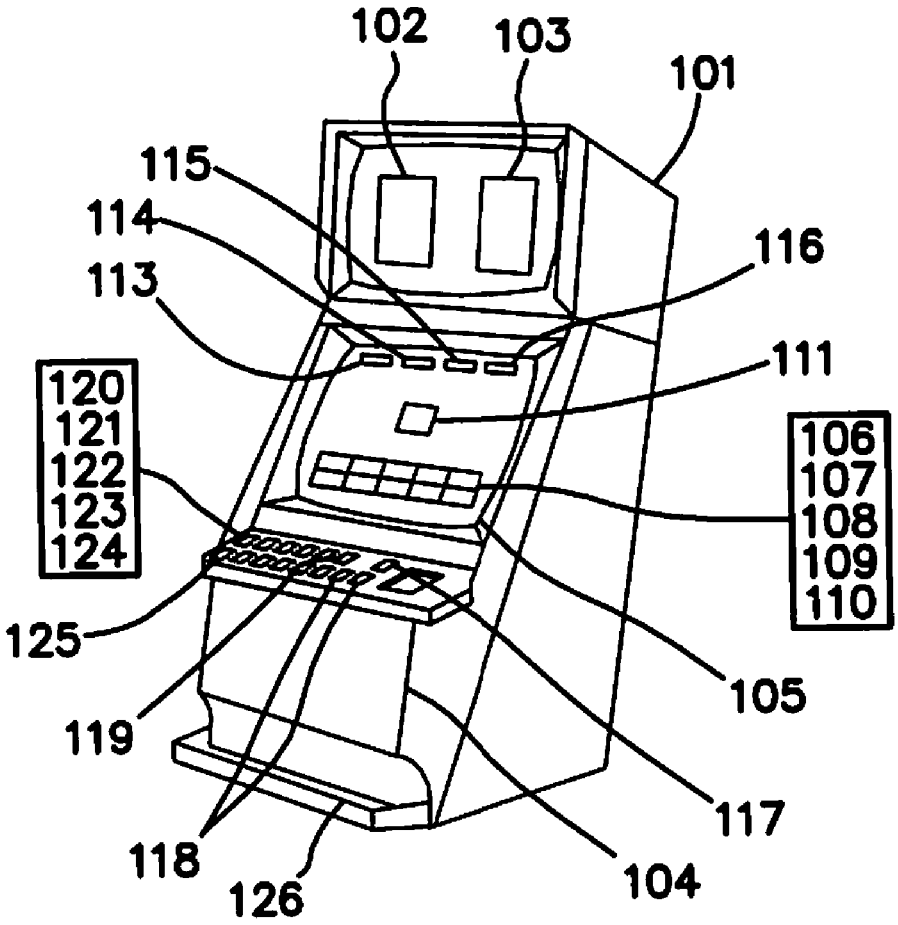
FIG. 1 shows an electronic gaming device of the type that may be used to facilitate the embodiments of the present invention.

A fourth embodiment comprises a electronic game version of the present invention wherein the tokens claimed are represented by a standard deck of playing cards with reference to FIG. 1.

On placement of a wager (117) varying values are optional by engaging the wager button (118) the display screen (105) will display the initial amount wagered (113) by the player.

The display screen (105) will display the five cards (106, 107,108,109,110) dealt as the players hand, face up and the one card (111) dealt as the dealers card, face down.

The initial players cards constitutes one of a pre determined automatic winning predefined hand (102) as displayed on the payout chart (102), the internal controller (101) will execute an automatic payout at the odds displayed on the predefined hands payout chart (102) and the game will be over.

The initial players cards constitutes a non-winning hand the internal controller (101) will automatically hold one, two or three cards of the players cards to maximise the advantage for the player.

The player has the option to alter any decision by engaging the hold buttons (120,121,122,123,124).

The player has the option of an additional wager by engaging the additional wager button (118) equal to the value of the initial wager (113). The additional wager will be displayed (114).

The player engages the deal button (119) whereby the players hold hand of one, two or three cards will remain displayed on the display screen (105). The dealers card (111)

is revealed resolving the result of a win or loss for the players hand as determined by the present invention.

Credits will be paid out (116) to the players credits (115) at the odds as indicated (103) by the internal controller (101) then the game will be over.

On activation of the cash out button (125) the internal controller will dispense into a tray (126) monetary value equal to the players credits (115)

There are a number of advantages of the present invention. The wagering structure of singular wagers with additional wagers when the player is in a commanding position is most attractive to all players.

Players participate most of the time to the end of each game thereby keeping their interest and participation concentrated on the game.

Casinos who install games with reasonable house percentages and high hand win rates find increasing player appeal and participation.

It will be appreciated that the games could also be played by other means, such as electronic gaming machines or via an on-line gaming websites.

The capabilities of technology are constantly expanding, and the improvements in technology should not be considered to avoid the underlining invention. For example player monitoring systems, security systems, integrated systems where shufflers identify the number of cards and/or identify the specific cards and their positions in the play of the game are contemplated in the practice of the present invention. It is possible to incorporate some degree or nearly an entire electronic system into the game table or into the play of the game. Such partial or complete electronic systems may perform such tasks as identifying the existence of a wager and/or may provide virtual cards from an electronically stored deck of cards.

It should be appreciated that the scope of the present invention need not be limited to the particular scope of the embodiments described above and in particular need not be limited to circumstances where the tokens used in the game comprise conventional playing cards or representations of conventional playing cards. All the examples, modifications and variations as would be apparent to a skilled addressee are deemed to be within the scope of the present invention.

The claims defining the invention are as follows:

1. A method of conducting a game comprising:

providing each player a collection of tokens from a set of tokens, said set of tokens formed of a subset of tokens wherein each subset includes an identical number of tokens, said subsets of tokens having a hierarchical ranking from lowest to highest;

causing each player to identify the player's collection of tokens as a winning collection of tokens, or a non-winning collection of tokens or an unplayable collection of tokens, said identification of a winning collection of tokens based on a player holding a collection of tokens belonging to a group of one or more pre-established winning collections of tokens;

after each player has identified the player's collection of tokens as a winning or non-winning collection of tokens or an unplayable collection of tokens, causing each player having identified a non-winning collection of tokens to discard one or more of the tokens from the non-winning hand such that the player holds no more than three tokens and no more than one token from any one of the subset of tokens;

providing an independent token from the remaining tokens in the set of tokens for comparison with each player's identified held non-winning collection of tokens;

determining, based on the comparison, whether any player's held non-winning collection of tokens comprises a winning or losing outcome.

2. The method of claim 1 further comprising providing each player an opportunity to place one or more wagers, including a jackpot wager, prior to each player receiving the collection of tokens and providing a payout to each player winning the game.

3. The method of claim 2 further comprising permitting a player identifying a winning collection of tokens and being provided a payout to continue in the game.

4. The method of claim 1 further comprising permitting additional wagers to be placed during various stages of the game.

5. The method of claim 1 further comprising providing a player a payout in response to the player identifying a winning collection of tokens, said payout based on a pre-established rank of the winning collection of tokens.

6. The method of claim 1 further comprising comparing a subset to which the independent token belongs with the subset or subsets to which the tokens held by the player belong.

7. The method of claim 6 further comprising determining that a player's held non-winning collection of tokens is a losing outcome should the independent token belong to a different subset than the subset or subsets of the one or more tokens held by the player.

8. The method of claim 1 further comprising comparing a subset and hierarchy of the independent token to a subset or subsets and hierarchy of the tokens held by the player.

9. The method of claim 8 further comprising determining that the player's held non-winning collection of tokens is a winning outcome should a player token belong to the same subset as the independent token and a rank higher than the independent token and a losing outcome should a player token belong to the same subset as the independent token but a rank lower than the independent token.

10. The method of claim 9 further comprising providing a payout on a winning outcome, said payout based on a number of tokens held in the player's hand.

11. The method of claim 10 further comprising establishing the payouts as follows:

| Number of tokens | Payout |
|---|---|
| 5 | 5 to 1 |
| 3 | 1 to 1 |
| 2 | 3 to 2 |
| 1 | 2 to 1 |

12. The method of claim 1 further comprising allowing a player to identify the player's collection of tokens as non-playable.

13. The method of claim 1 further comprising providing a single independent token for comparison with each player's held non-winning collection of tokens.

14. The method of claim 1 further comprising providing an independent token to each player for comparison with that player's held non-winning collection of tokens.

15. The method of claim 1 further comprising requiring that, after the discard, the player's held non-winning collection of tokens comprises no more than one token from any subset.

16. The method of claim 1 further comprising providing two or more subsets.

17. The method of claim 16 further comprising providing a plurality of tokens in each subset.

18. The method of claim 17 further comprising providing each player with two or more tokens.

19. The method of claim 18 further comprising causing each player to hold a number of tokens after discards equal to or less than the number of subsets wherein no tokens are from the same subset.

20. The method of claim 1 further comprising utilizing playing cards, tiles, balls, dice, or any appropriate object as the tokens.

21. The method of claim 1 further comprising utilizing pre-established combinations of colors, symbols and or numerical values to determine winning collections of tokens.

22. The method of claim 20 further comprising utilizing playing card rankings, colors or any symbols and numerical values to determine winning outcomes.

23. The method of claim 1 facilitated by an electronic gaming device.

24. The method of claim 1 facilitated by a live dealer.

25. A method of conducting a card game comprising: providing each player with a plurality of playing cards from one or more standard decks of playing cards thereby causing each player to hold a hand;

causing each player to identify the player's hand as a winning hand, non-winning hand or unplayable hand, said identification of a winning hand based on a player holding a hand belonging to a group of one or more pre-established winning hands;

after each player has identified the status of the player's hand, causing each player having identified a non-winning hand to discard one or more of the cards from the non-winning hand such that the player holds no more than three cards and no more than one card of any suit;

providing an independent playing card from the remaining deck for comparison with the cards held by each player in each non-winning hand; and determining, based on the comparison, whether any player's held cards from a non-winning hand comprise a winning or losing outcome.

26. The method of claim 25 further comprising providing each player an opportunity to place one or more wagers, including a jackpot wager, prior to receiving the plurality of playing cards and providing a payout to each player holding a winning hand or on winning the game.

27. The method of claim 26 further comprising permitting a player identifying a winning hand to place and being provided a payout to continue in the game.

28. The method of claim 25 further comprising permitting additional wagers to be placed during various stages of the game.

29. The method of claim 25 further comprising providing a player a payout in response to the player identifying a winning hand, said payout based on a poker rank of the winning hand.

30. The method of claim 25 further comprising comparing a suit of the independent card to the suit or suits of the cards held by the player.

31. The method of claim 30 further comprising determining that a player's held hand is a losing hand should the independent card have a different suit than the suit or suits of the one or more cards held by the player.

32. The method of claim 25 further comprising comparing a suit and hierarchy of the independent card to a suit or suits and hierarchy of the cards held by the player.

33. The method of claim 32 further comprising determining that a player's held hand is a winning outcome should a player card have the same suit as the independent card and a rank higher than the independent card and a losing outcome should a player card have the same suit as the independent card but a rank lower than the independent card.

34. The method of claim 33 further comprising providing a payout on a winning outcome, said payout based on a number of cards in the player's hand.

35. The method of claim 34 further comprising establishing the payouts as follows:

| Number of Cards | Payout |
|---|---|
| 5 | 5 to 1 |
| 3 | 1 to 1 |
| 2 | 3 to 2 |
| 1 | 2 to 1 |

36. The method of claim 25 further comprising allowing a player to identify the player's hand as non-playable.

37. The method of claim 25 further comprising providing a single independent card for comparison with each player's held hand.

38. The method of claim 25 further comprising providing an independent card to each player for comparison with that player's held hand.

39. The method of claim 25 further comprising providing each player with three or more cards.

40. The method of claim 39 further comprising causing each player to hold three or less cards after discards wherein no cards have the same suit.

41. The method of claim 25 further comprising utilizing playing card rankings to determine winning outcomes.

42. The method of claim 25 further comprising utilizing a group of one or more pre-established winning hands to determine a winning hand held by the player.

43. The method of claim 25 further comprising including one or more jokers in the one or more standard decks of playing cards.

44. The method of claim 25 facilitated by an electronic gaming device.

45. The method of claim 25 facilitated by a live dealer.

46. A method of conducting a card game comprising:

providing each player with five playing cards from one or more standard decks of playing cards thereby causing each player to hold a hand:

causing each player to identify the players hand as a winning hand, non-winning hand or non-playable hand, said winning and non-playable hands based on a player holding a hand belonging to a group of one or more pre-established winning and non-playable hands, respectively;

after each player has identified the player's hand as winning, non-winning or non-playable, causing each player having identified a non-winning hand to discard one or more of the cards from the non-winning hand such that the player holds no more than three cards and no more than one card of any suit, providing an independent playing card from the remaining deck for comparison with the cards from each non-winning hand held by each player; and determining, based on the comparison, whether any player's held cards comprise a winning or losing outcome wherein player's held hand is winning outcome should a player card have the same suit as the independent card and a rank higher than the independent card and a losing outcome should a player card have the same suit as the independent card but a rank lower than the independent card.

47. The method of claim 46 further comprising providing each player an opportunity to place one or more wagers, including a jackpot wager, prior to receiving the five playing cards and providing a payout to each player holding a winning or a non-playable hand, or on winning the game.

48. The method of claim 47 further comprising permitting a player identifying a winning hand and being provided a payout to continue in the game.

49. The method of claim 46 further comprising permitting additional wagers to be placed during various stages of the game.

50. The method of claim 46 further comprising providing a player a payout in response to the player identifying a winning hand, said payout based on a poker rank of the winning hand.

51. The method of claim 46 further comprising comparing a suit of the independent card to the suit or suits of the cards held by the player.

52. The method of claim 46 further comprising providing a payout on a winning outcome, said payout based on a number of cards in the player's hand.

53. The method of claim 46 further comprising establishing the payouts as follows:

| Number of Cards | Payout |
|---|---|
| 5 | 5 to 1 |
| 3 | 1 to 1 |
| 2 | 3 to 2 |
| 1 | 2 to 1 |

54. The method of claim 46 further comprising providing a single independent card for comparison with each player's held hand.

55. The method of claim 46 further comprising providing an independent card to each player for comparison with that player's held hand.

56. The method of claim 46 further comprising including one or more jokers in the one or more standard decks of playing cards.

57. The method of claim 46 facilitated by an electronic gaming device.

58. The method of claim 46 facilitated by a live dealer.

* * * * *